US008057200B2

(12) United States Patent
Kang et al.

(10) Patent No.: US 8,057,200 B2
(45) Date of Patent: Nov. 15, 2011

(54) STRUCTURE OF DISCHARGING REFRIGERANT FOR LINEAR COMPRESSOR

(75) Inventors: Kyoung-Seok Kang, Changwon-si (KR); Yangjun Kang, Changwon-si (KR); Jong-Koo Lee, Suwon-si (KR); Jin-taek Oh, Seoul (KR); Min-Woo Lee, Gimhae-si (KR); Kwang-Wook Kim, Incheon (KR); Gye-Young Song, Seoul (KR)

(73) Assignee: LG Electronics Inc., Seoul (KR)

( * ) Notice: Subject to any disclaimer, the term of this patent is extended or adjusted under 35 U.S.C. 154(b) by 496 days.

(21) Appl. No.: 12/087,768

(22) PCT Filed: Jan. 16, 2007

(86) PCT No.: PCT/KR2007/000269

§ 371 (c)(1),
(2), (4) Date: Jul. 15, 2008

(87) PCT Pub. No.: WO2007/081193

PCT Pub. Date: Jul. 19, 2007

(65) Prior Publication Data

US 2009/0081054 A1 Mar. 26, 2009

(30) Foreign Application Priority Data

Jan. 16, 2006 (KR) ..... 10-2006-0004646

(51) Int. Cl.
*F04B 11/00* (2006.01)

(52) U.S. Cl. ..... 417/540; 417/312; 417/417; 417/571; 181/274; 181/403

(58) Field of Classification Search ..... 417/312, 417/571, 416, 417, 540, 541, 542; 181/274, 181/403

See application file for complete search history.

(56) References Cited

U.S. PATENT DOCUMENTS

| | | | | |
|---|---|---|---|---|
| 3,044,688 | A * | 7/1962 | Frank et al. | 417/312 |
| 3,202,344 | A * | 8/1965 | Clausen | 29/888.02 |
| 4,988,269 | A * | 1/1991 | Blass | 417/312 |
| 6,824,365 | B2 * | 11/2004 | Park et al. | 417/312 |
| 2002/0071774 | A1 * | 6/2002 | Lee | 417/312 |
| 2004/0202562 | A1 | 10/2004 | Grassbaugh et al. | |
| 2004/0241012 | A1 * | 12/2004 | Kim et al. | 417/312 |
| 2004/0247457 | A1 * | 12/2004 | Kim et al. | 417/312 |
| 2005/0142014 | A1 * | 6/2005 | Jung et al. | 417/540 |

FOREIGN PATENT DOCUMENTS

| | | |
|---|---|---|
| CN | 1360150 | 7/2002 |
| CN | 1444697 | 9/2003 |
| JP | 2004-520536 | 7/2004 |
| KR | 10-2002-0038411 | 5/2002 |
| WO | WO 02/095231 | 11/2002 |

* cited by examiner

*Primary Examiner* — Devon C Kramer
*Assistant Examiner* — Leonard Weinstein
(74) *Attorney, Agent, or Firm* — McKenna Long & Aldridge LLP

(57) ABSTRACT

The present invention discloses a linear compressor in which a piston is linearly reciprocated inside a cylinder, for sicking a refrigerant into a compression space between the piston and the cylinder, and compressing and discharging the refrigerant, and especially, a structure of discharging the refrigerant for the linear compressor which can reduce a pulsation of a high pressure discharged refrigerant, by making the refrigerant compressed in the compression space flow from a sub-discharge space with a relatively small volume to a sub-discharge space with a relatively large volume in a discharge chamber. As a result, the structure of discharging the refrigerant for the linear compressor can efficiently reduce noise and vibration.

10 Claims, 5 Drawing Sheets

[Fig. 1]
PRIOR ART
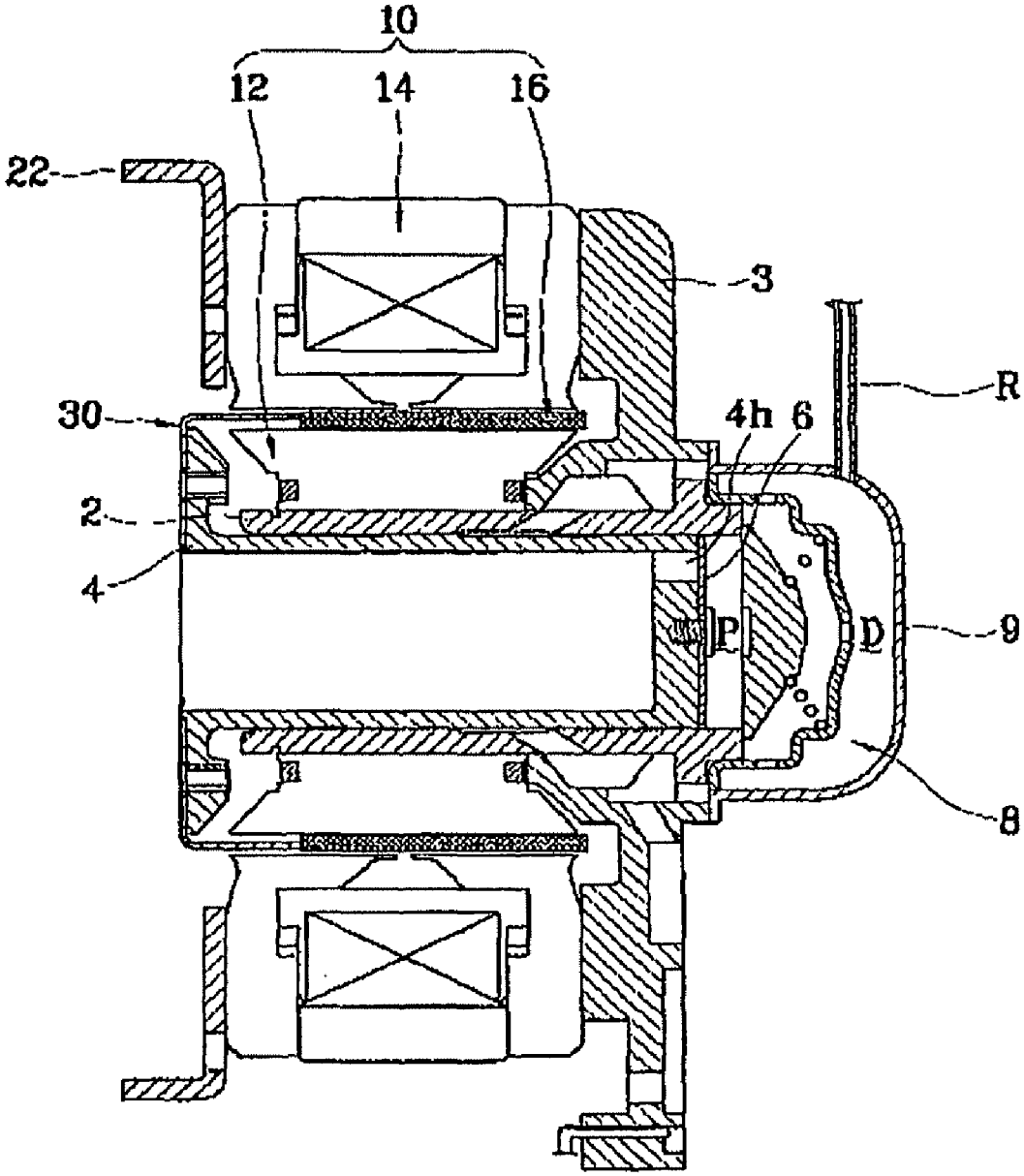

[Fig. 2]
PRIOR ART
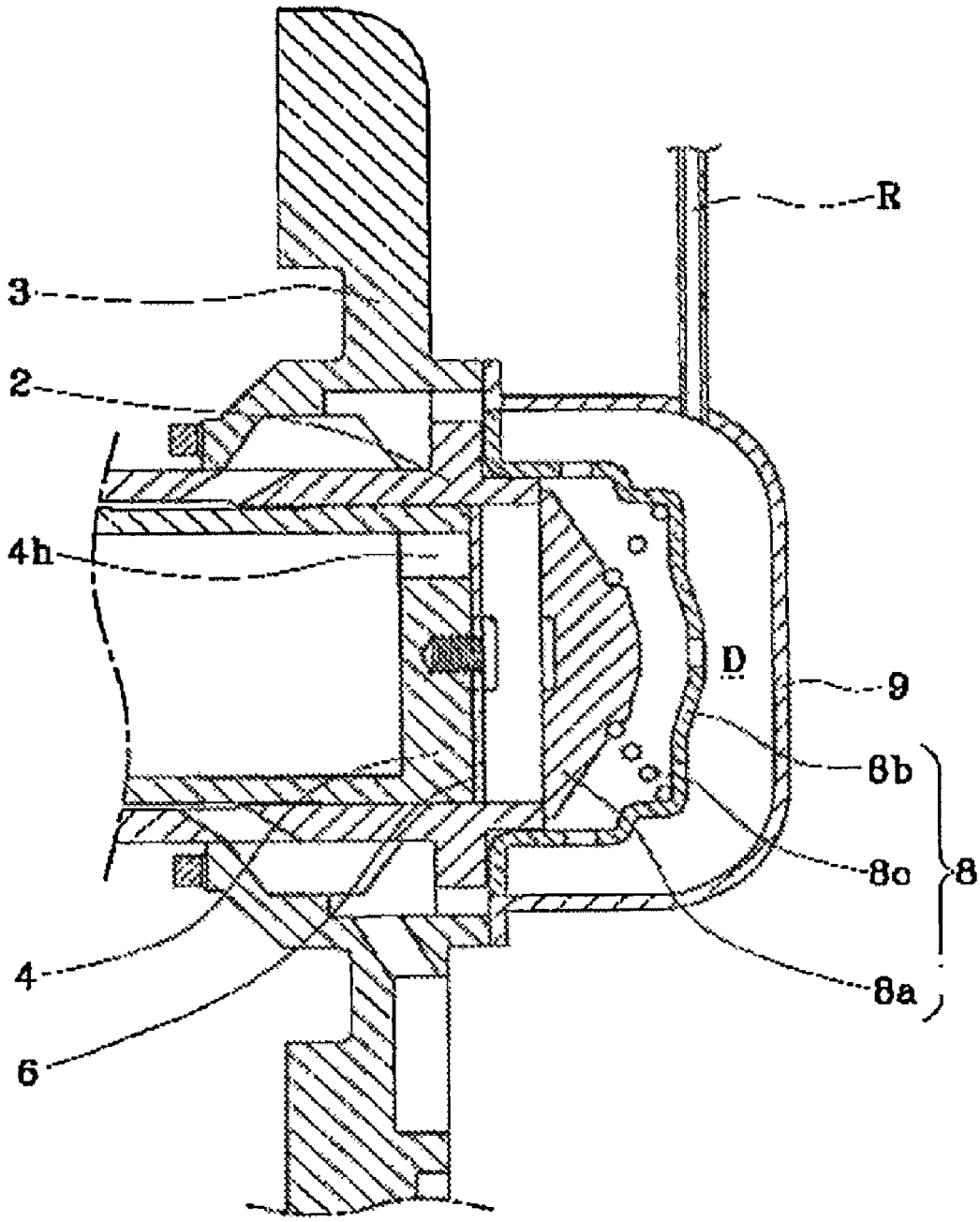

[Fig. 3]
PRIOR ART
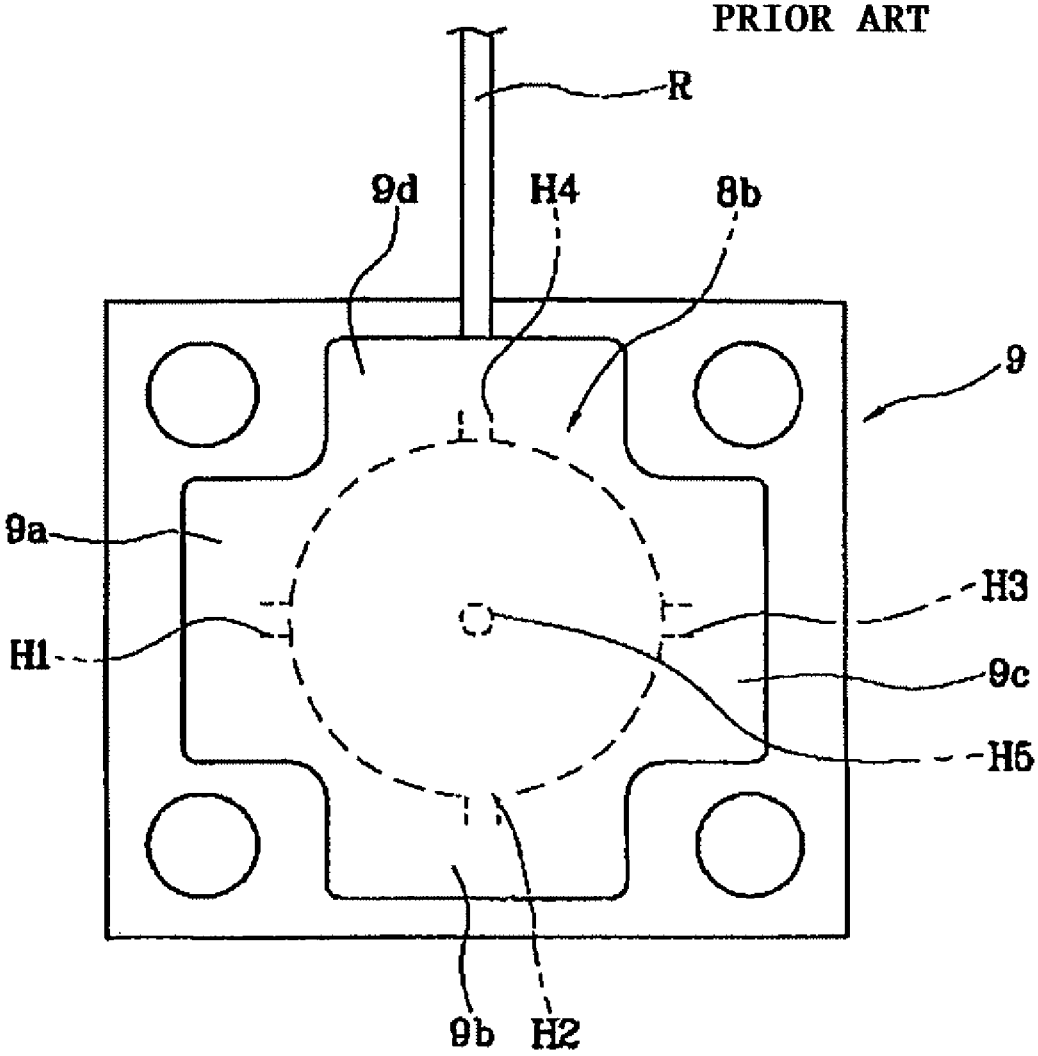

[Fig. 4]
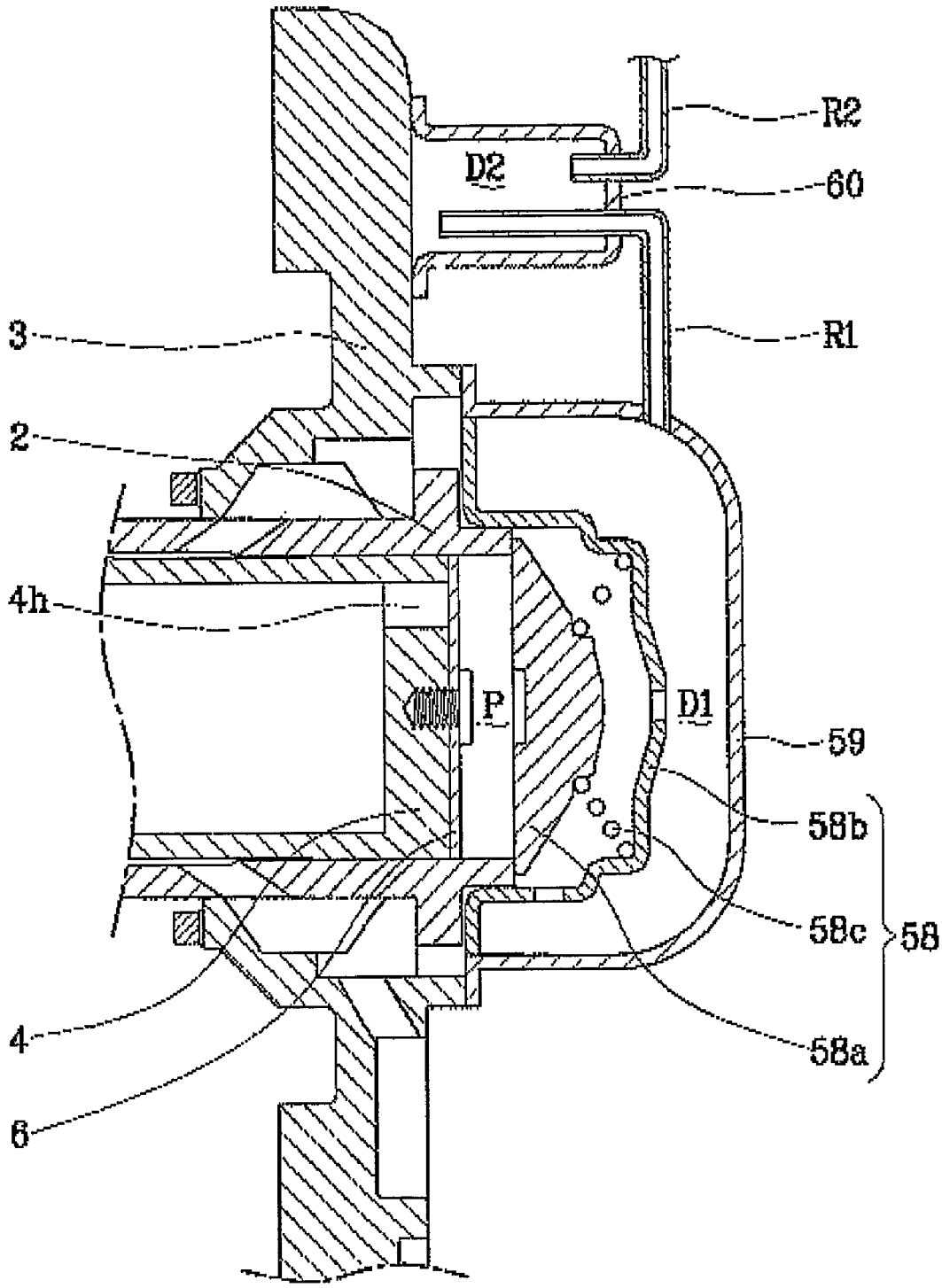

[Fig. 5]
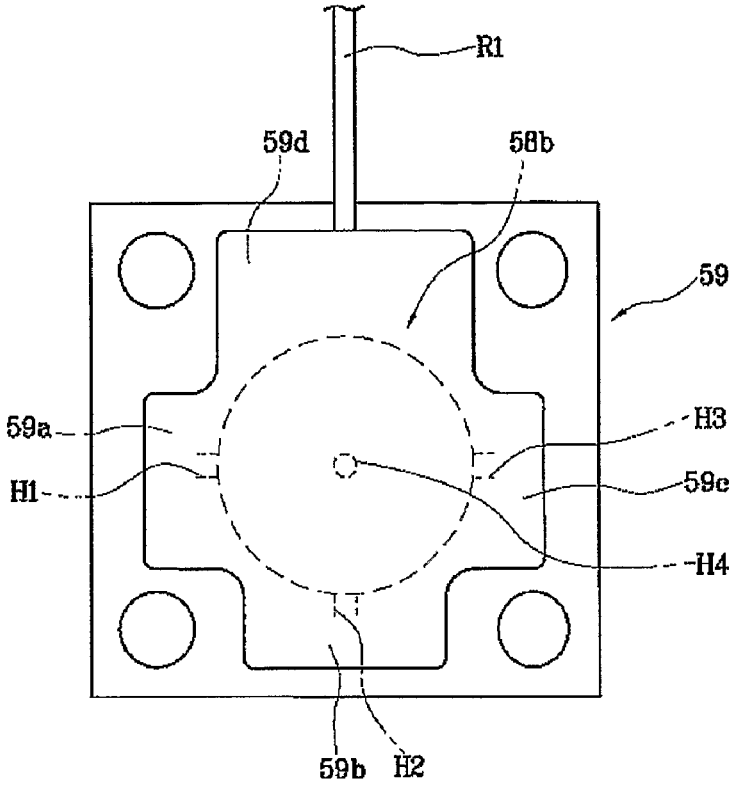
[Fig. 6]
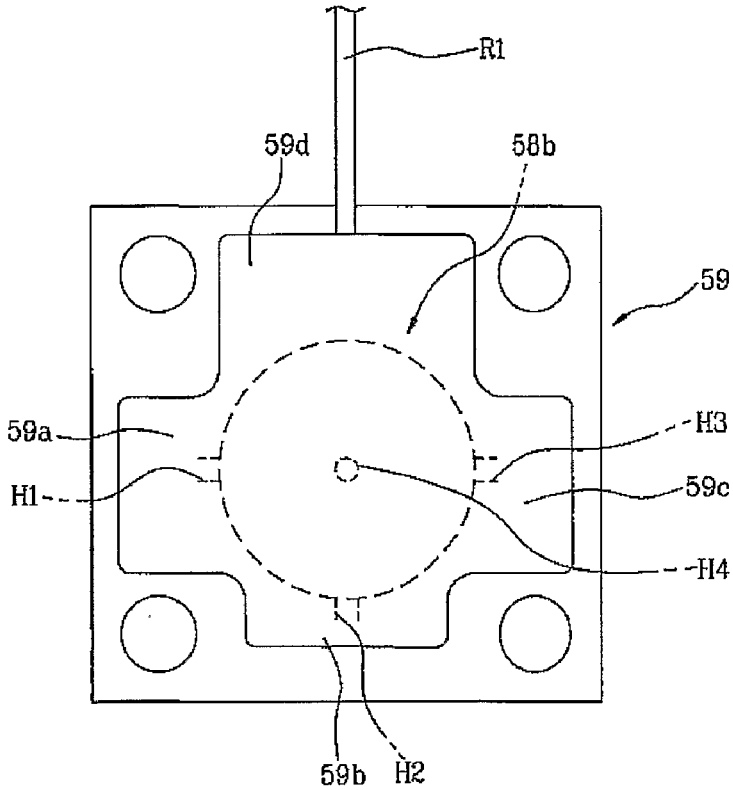

STRUCTURE OF DISCHARGING REFRIGERANT FOR LINEAR COMPRESSOR

This application claims priority to International application No. PCT/KR2007/000269 filed on Jan. 16, 2007 which claims priority to Korean Application No. 10-2006-0004646 filed Jan. 16, 2006, both of which are incorporated by reference, as if fully set forth herein.

TECHNICAL FIELD

The present invention relates to a linear compressor in which a piston is linearly reciprocated inside a cylinder, for sucking a refrigerant into a compression space between the piston and the cylinder, and compressing and discharging the refrigerant, and more particularly, to a structure of discharging a refrigerant for a linear compressor which can reduce a pulsation of a high pressure discharged refrigerant, by making the refrigerant compressed in a compression space flow from a sub-discharge space with a relatively small volume to a sub-discharge space with a relatively large volume in a discharge cap.

BACKGROUND ART

FIG. 1 is a side-sectional view illustrating part of a general linear compressor, and FIGS. 2 and 3 are a side-sectional view and a front view illustrating a conventional structure of discharging a refrigerant for the linear compressor, respectively.

Referring to FIG. 1, in the linear compressor, in a hermetic space of a shell (not shown), one end of a cylinder 2 is fixedly supported by a main body frame 3, and one end of a piston 4 is inserted into the cylinder 3, for forming a compression space P between the cylinder 3 and the piston 4. The piston 4 is connected to a linear motor 10 and reciprocated in the axial direction, for sucking a refrigerant into the compression space P and discharging the refrigerant.

Here, the compression space P for compressing the refrigerant is formed between one end of the cylinder 2 and the piston 4. A suction hole 4*h* is formed at one end of the piston 4 in the axial direction, for sucking the refrigerant into the compression space P, and a thin film type suction valve 6 is bolt-fastened to one end of the piston 4, for opening and closing the suction hole 4*h*. A discharge valve assembly 8 is installed at one end of the cylinder 2, for discharging the refrigerant compressed in the compression space P.

The linear motor 10 includes a ring-shaped inner stator 12 formed by laminating a plurality of laminations in the circumferential direction, and fixed to the outer circumference of the cylinder 2, a ring-shaped outer stator 14 formed by laminating a plurality of laminations in the circumferential direction outside a coil winding body formed by winding a coil in the circumferential direction, and disposed outside the inner stator 12 with an interval, and a permanent magnet 16 disposed in the space between the inner stator 12 and the outer stator 14, and linearly reciprocated by a mutual electromagnetic force by the inner stator 12 and the outer stator 14.

One end of the inner stator 12 is supported by the main body frame 3, and the other end thereof is fixed to the outer circumference of the cylinder 2 by a fixing ring (not shown). In addition, one end of the outer stator 14 is supported by the main body frame 3, and the other end thereof is supported by a motor cover 22. The motor cover 22 is bolt-fastened to the main body frame 3. The permanent magnet 16 is connected to the other end of the piston 4 by a connection member 30.

When a current is applied to the outer stator 14, the permanent magnet 16 is linearly reciprocated by the mutual electromagnetic force by the inner stator 12 and the outer stator 14, and the piston 4 is linearly reciprocated inside the cylinder 2. As a pressure inside the compression space P is varied, the suction valve 6 and the discharge valve assembly 8 are operated to suck, compress and discharge the refrigerant.

The conventional structure of discharging the refrigerant for the linear compressor will now be explained with reference to FIGS. 2 and 3. The conventional structure of discharging the refrigerant includes the discharge valve assembly 8 installed at one end of the cylinder 2 to be opened and closed, for discharging the refrigerant from the compression space P, a discharge cap 9 installed at one end of the cylinder 2 to cover the discharge valve assembly 8, for forming a discharge chamber D to which the refrigerant is discharged, and a loop pipe R connected to the discharge cap 9, for reducing noise and vibration of the high pressure discharged refrigerant. The discharge chamber D is partitioned off into discharge spaces 9*a*, 9*b*, 9*c* and 9*d*, for example, by a curved shape of the discharge cap 9.

In detail, the discharge valve assembly 8 includes a discharge valve 8*a* for opening and closing one end of the cylinder 2, a support cap 8*b* fixed to one end of the cylinder 2, for covering the discharge valve 8*a*, and a discharge valve spring 8*c* for elastically opening and closing the discharge valve 8*a* on one end of the cylinder 2 according to the pressure inside the compression space P.

Communication holes H1, H2, H3 and H4 for discharging the refrigerant to the discharge cap 9 are formed on the circumference of the support cap 8*b* at intervals. The discharge spaces 9*a*, 9*b*, 9*c* and 9*d* are formed on the discharge cap 9 to correspond to the communication holes H1, H2, H3 and H4, respectively. The discharge spaces 9*a*, 9*b*, 9*c* and 9*d* communicate to each other.

As the piston 4 is linearly reciprocated inside the cylinder 2, the refrigerant sucked into the compression space P is compressed. If the pressure inside the compression space P exceeds a set pressure, the discharge valve spring 8*c* is compressed to open the discharge valve 8*a*. The high pressure refrigerant of the compression space P is passed through the communication holes H1, H2, H3 and H4 of the support cap 8*b*, temporarily collected in the discharge chamber D inside the discharge cap 9, reduced in vibration and noise through the relatively thin and long loop pipe R, and externally discharged.

In the conventional structure of discharging the refrigerant for the linear compressor, the refrigerant compressed at a high pressure in the compression space P by linear reciprocation of the piston 4 generates a pulsation, passes through the communication holes H1, H2, H3 and H4 formed on the circumference of the support cap 8*b* of the discharge valve assembly 8 at intervals, and is discharged to the discharge chamber D which is one up-down and left-right symmetric limited space. That is, even if the pulsation is generated in the high pressure refrigerant, the refrigerant flows through the loop pipe P. Therefore, the pulsation of the refrigerant is maintained high, which increases noise and vibration.

DISCLOSURE OF INVENTION

Technical Problem

An object of the present invention is to provide a structure of discharging a refrigerant for a linear compressor which can externally discharge the refrigerant with its pulsation reduced, by making the refrigerant sequentially pass through discharge spaces with different volumes, even if the high pressure refrigerant is discharged from a compression space, generating the pulsation.

Technical Solution

There is provided a structure of discharging a refrigerant for a linear compressor, comprising: a cylinder in which the refrigerant flows in the axial direction; a piston reciprocated inside the cylinder to compress a fluid; a discharge valve assembly installed at one end of the cylinder and opened and closed to discharge the refrigerant; and a discharge cap covering the discharge valve assembly, and having a discharge space partitioned into different sizes of sub-discharge spaces that the refrigerant is discharged from the discharge valve assembly to the discharge space, for reducing a pulsation of the refrigerant by making the refrigerant flow from the sub-discharge space with a relatively small volume to the sub-discharge space with a relatively large volume. By this configuration, when the refrigerant flows, the volumes of the refrigerant flowing spaces are changed to reduce the pulsation of the refrigerant.

In another aspect of the present invention, the structure of discharging the refrigerant further includes a first loop pipe having its one end connected to the sub-discharge space with the large volume in the discharge cap, and guiding external discharge of the refrigerant. By this configuration, the refrigerant can be externally discharged from the compressor with its pulsation reduced.

In another aspect of the present invention, the discharge valve assembly includes a communication hole for discharging the refrigerant to the sub-discharge space with the small volume. By this configuration, the refrigerant is discharged to the sub-discharge space with the small volume, and easily transferred to the sub-discharge space with the large volume.

In another aspect of the present invention, the structure of discharging the refrigerant further includes: a first loop pipe having its one end connected to the discharge cap, and guiding external discharge of the refrigerant; and a buffering cap connected to the other end of the first loop pipe, for reducing the pulsation. By this configuration, the refrigerant is externally discharged from the compressor after the pulsation thereof is reduced once more.

In another aspect of the present invention, the buffering cap has a smaller volume than the discharge cap. By this configuration, the volumes of the refrigerant flowing spaces are changed to more reduce the pulsation of the refrigerant.

In another aspect of the present invention, the discharge cap further includes an additional sub-discharge space which is smaller than the sub-discharge space with the large volume and larger than the sub-discharge space with the small volume between the sub-discharge space with the large volume and the sub-discharge space with the small volume. By this configuration, since the refrigerant undergoes the volume changes of the flowing spaces a few times, the pulsation of the refrigerant can be considerably reduced.

In another aspect of the present invention, the structure of discharging the refrigerant further includes a second loop pipe having its one end connected to the buffering cap, and guiding the refrigerant to be externally discharged from the buffering cap.

In another aspect of the present invention, the other end of the first loop pipe and one end of the second loop pipe are installed at an interval from each other inside the buffering cap. By this configuration, since the refrigerant flows from the other end of the first loop pipe to one end of the second loop pipe inside the buffering cap, the pulsation of the refrigerant is reduced.

In another aspect of the present invention, any one of the other end of the first loop pipe and one end of the second loop pipe is positioned more deeply in the buffering cap.

And there is provided a structure of discharging a refrigerant for a linear compressor, comprising: a cylinder in which the refrigerant flows in the axial direction; a piston reciprocated inside the cylinder, for compressing a fluid; a discharge valve assembly installed at one end of the cylinder and opened and closed, discharging the refrigerant; and a discharge cap for covering the discharge valve assembly, the discharge cap being partitioned into a plurality of sub-discharge spaces with a small volume and one sub-discharge space with a large volume that the refrigerant are discharged from the discharge valve assembly to the sub-discharge spaces, for reducing a pulsation of the refrigerant by making the refrigerant flow from the sub-discharge spaces with the relatively small volume to the sub-discharge space with the relatively large volume.

The discharge cap is partitioned off the sub-discharge spaces with the small volume and the sub-discharge space with the large volume according to its curved shape. By this configuration, the pulsation of the refrigerant can be suppressed without using an additional member.

In another aspect of the present invention, the sub-discharge spaces with the small volume and the sub-discharge space with the large volume are arranged along an outer circumference of a discharge valve. By this configuration, since the discharge spaces are arranged on the same plane surface, the structure of reducing the pulsation of the refrigerant can be provided without increasing the whole size of the compressor.

And there is provided a structure of discharging a refrigerant for a linear compressor, comprising: a cylinder in which the refrigerant flows in the axial direction; a piston reciprocated inside the cylinder, for compressing a fluid; a discharge valve assembly installed at one end of the cylinder and opened and closed, for discharging the refrigerant; a discharge cap having a discharge space to which the refrigerant is discharged from the discharge valve assembly; a first loop pipe having its one end connected to the discharge cap, and guiding the refrigerant to be externally discharged from the discharge cap; and a buffering cap connected to the other end of the first loop pipe, for reducing a pulsation of the refrigerant. By this configuration, since the refrigerant is discharged to the discharge cap, and then discharged to the buffering cap through the first loop pipe, the pulsation of the refrigerant is reduced.

In another aspect of the present invention, the structure of discharging the refrigerant further includes a frame on which one end of the cylinder is installed, and the buffering cap is installed on the frame. By this configuration, the buffering cap can be fixed without using a special frame for installing the buffering cap. It is thus possible to efficiently use the inside space of the linear compressor.

The buffering cap has a smaller volume than the discharge cap. By this configuration, the volumes of the refrigerant discharge spaces are changed to efficiently reduce the pulsation of the refrigerant.

The structure of discharging the refrigerant further includes a second loop pipe having its one end connected to the buffering cap, and guiding the refrigerant to be externally discharged from the buffering cap. Any one of the other end of the first loop pipe and one end of the second loop pipe is positioned more deeply in the buffering cap. By this configuration, when the refrigerant is supplied from the discharge cap to the buffering cap through the first loop pipe, the pulsation of the refrigerant is always reduced in the buffering cap. Thereafter, the refrigerant is externally discharged from the buffering cap through the second loop pipe.

Advantageous Effects

In accordance with the present invention, in the structure of discharging the refrigerant for the linear compressor, when the piston is linearly reciprocated inside the cylinder, the refrigerant is compressed and discharged to the discharge cap regardless of generation of the pulsation. As the refrigerant flows from the sub-discharge space with the relatively small volume to the sub-discharge space with the relatively large volume in the discharge cap, the pulsation of the refrigerant can be reduced. Furthermore, since the refrigerant sequentially passes through the predetermined volumes of discharge cap and buffering cap and then flows into the second loop pipe, the pulsation of the refrigerant can be reduced. As a result, vibration and noise generated by the pulsation of the refrigerant can be efficiently suppressed.

BRIEF DESCRIPTION OF THE DRAWINGS

FIG. 1 is a side-sectional view illustrating part of a general linear compressor;

FIG. 2 is a side-sectional view illustrating a conventional structure of discharging a refrigerant for the linear compressor;

FIG. 3 is a front view illustrating the conventional structure of discharging the refrigerant for the linear compressor;

FIG. 4 is a side-sectional view illustrating a structure of discharging a refrigerant for a linear compressor in accordance with the present invention; and FIGS. 5 and 6 are front views illustrating the structure of discharging the refrigerant for the linear compressor in accordance with the present invention.

MODE FOR THE INVENTION

A stricture of discharging a refrigerant for a linear compressor in accordance with the preferred embodiments of the present invention will now be described in detail with reference to the accompanying drawings.

FIGS. 4 to 6 are a side-sectional view and front views illustrating the linear compressor in accordance with the present invention.

As illustrated in FIGS. 4 and 5, in the structure of discharging the refrigerant for the linear compressor, one end of a cylinder 2 is fixed to a frame 3, a piston 4 is inserted into the other end of the cylinder 2 and linearly reciprocated inside the cylinder 2, a discharge space D1 is formed at one end of the cylinder 2, a buffering space D2 is formed with an interval from the discharge space D1, a first loop pipe R1 in which the refrigerant flows is installed between the discharge space D1 and the buffering space D2, and a second loop pipe R2 for guiding external discharge of the refrigerant is connected to the buffering space D2. In the discharge space D1, the refrigerant flows from sub-discharge spaces 59*a*, 59*b* and 59*c* with a relatively small volume to a sub-discharge space 59*d* with a relatively large volume. Therefore, a pulsation of the refrigerant is reduced.

The discharge space D1 is defined by a discharge valve assembly 58 and a discharge cap 59, and the buffering space D2 is defined by the frame 3 and a buffering cap 60.

In detail, one end of the cylinder 2 passes through the frame 3. A compression space P is formed inside one end of the cylinder 2, and the discharge valve assembly 58 is installed outside one end of the cylinder 2 to be opened and closed.

Especially, the discharge valve assembly 58 includes a discharge valve 58*a* for opening and closing one end of the cylinder 2, a support cap 58*b* isolated to cover the discharge valve 58*a*, and fixed to one end of the cylinder 2, and a discharge valve spring 58*c* for elastically supporting the discharge valve 58*a* on the support cap 58*b*.

The portion of the discharge valve 58*a* contacting one end of the cylinder 2 is formed flat, and the opposite portion thereof is upwardly protruded toward the center portion, namely, convex. Therefore, the discharge valve 58*a* can resist a high pressure of the compression space P. Preferably, a settling groove (not shown) is formed on the discharge valve 58*a*, for supporting the discharge valve spring 58*c*.

The diameter of one end of the discharge valve spring 58*c* contacting the discharge valve 58*a* is smaller than that of the other end of the discharge valve spring 58*c* contacting the support cap 58*b*, thereby stably supporting the discharge valve 58*a*. The opened end of the support cap 58*b* is fixed to the frame 3 adjacent to the circumference of one end of the cylinder 2, and the closed end of the support cap 58*b* supports the discharge valve spring 58*c*. Preferably, a plurality of communication holes H1, H2 and H3 are formed on the circumference of the support cap 58*b*, for discharging the refrigerant.

Preferably, three communication holes H1, H2 and H3 are formed on the circumference of the support cap 58*b* at intervals of 90 in the circumferential direction. The inside shape of the discharge cap 59 is determined according to the communication holes H1, H2 and H3, which will later be explained in detail.

Accordingly, if the pressure inside the compression space P is over a set pressure, the discharge valve spring 58*c* is compressed, one side of the discharge valve 58*a* is opened from one end of the cylinder 2, and thus the high pressure refrigerant is discharged to the discharge cap 59 through each communication hole H1, H2 and H3.

The discharge cap 59 covers the support cap 58*b* with an interval from the support cap 58*b*. The opened end of the discharge cap 59 is fixed to the frame 3 to completely cover the support cap 58*b*.

In more detail, the first, second, third and fourth sub-discharge spaces 59*a*, 59*b*, 59*c* and 59*d* are formed inside the discharge cap 59 to communicate with each other. Here, the first, second and third sub-discharge spaces 59*a*, 59*b* and 59*c* have a relatively small volume, and the fourth sub-discharge space 59*d* has a relatively large volume. The first, second, third and fourth sub-discharge spaces 59*a*, 59*b*, 59*c* and 59*d* are formed in the discharge cap 59 at intervals of 90 in the circumferential direction.

Preferably, the discharge cap 59 covers the support cap 58*b* so that the communication holes H1, H2 and H3 of the support cap 58*b* can correspond to the first, second and third sub-discharge spaces 59*a*, 59*b* and 59*c* of the discharge cap 59, respectively.

One example of the structure in which the communication holes H1, H2 and H3 of the support cap 58*b* correspond to the first, second and third sub-discharge spaces 59*a*, 59*b* and 59*c* of the discharge cap 59 will now be explained. The high pressure refrigerant discharged from the communication holes H1, H2 and H3 of the support cap 58*b* is distributed to the first, second and third sub-discharge spaces 59*a*, 59*b* and 59*c* of the discharge cap 59 with the relatively small volume, and then collected in the fourth sub-discharge space 59*d* of the discharge cap 59 with the relatively large volume. Thus, the pulsation of the refrigerant is reduced.

Another example of forming the first, second, third and fourth sub-discharge spaces 59*a*, 59*b*, 59*c* and 59*d* will now be described. The first sub-discharge space 59*a* has the smallest volume, the second and third sub-discharge spaces 59*b* and 59*c* have a larger volume than the first sub-discharge space 59*a*, and the fourth sub-discharge space 59*d* has the largest volume. That is, this structure reduces the pulsation of the refrigerant discharged from the first sub-discharge space 59*a* once more. As a result, the pulsation of the refrigerant is considerably suppressed.

In addition to the communication holes H1, H2 and H3 formed on the support cap 58*b* in the circumferential direction, a communication hole H4 can be formed at the center portion of the support cap 58*b*. As the refrigerant discharged from the communication hole H4 also flows to the fourth sub-discharge space 59*d* in the discharge cap 59, the pulsation of the refrigerant is reduced.

The buffering cap 60 has a smaller volume than the discharge cap 59. The opened end of the buffering cap 60 is fixed to the frame 3 so that the buffering cap 60 can be disposed at one side of the discharge cap 59.

Preferably, the discharge cap 59 is sufficiently large to reduce the pressure of the refrigerant, when the high pressure refrigerant is discharged from the compression space P. However, since the buffering cap 60 merely reduces the pulsation of the refrigerant transferred from the discharge cap 59, the volume of the buffering cap 60 can be set smaller than that of the discharge cap 59.

Although the discharge cap 59 and the buffering cap 60 are fixedly installed on the frame 3, since one surface of the frame 3 is not flat, the discharge cap 59 and the buffering cap 60 are not disposed on the same plane surface.

The first loop pipe R1 and the second loop pipe R2 are pipes with a small diameter. The first loop pipe R1, which is relatively short, is installed between the discharge cap 59 and the buffering cap 60, for guiding flow of the refrigerant. The second loop pipe R2, which is relatively long, is installed between the buffering cap 60 and the external space to guide flow of the refrigerant and reducing noise by the pulsation of the refrigerant.

The first loop pipe R1 communicates with the fourth sub-discharge space 59*d* of the discharge cap 59, so that the refrigerant collected in the fourth sub-discharge space 59*d* of the discharge cap 59 can be discharged to the buffering cap 60.

In the case of the first loop pipe R1, a thin pipe can be installed in a straight line shape. In the case of the second loop pipe R2, a thin and long pipe is preferably curvedly installed to efficiently reduce vibration and noise of the refrigerant. In order to minimize vibration and noise of the refrigerant, a buffering member (not shown) such as rubber can be installed in a section of the second loop pipe R2 in consideration of a vibration frequency of the refrigerant.

Especially to buffer the pulsation of the refrigerant in the buffering cap 60, the end of the first loop pipe R1 and the end of the second loop pipe R2 are preferably disposed in the opposite directions in the buffering cap 60 to be distant from each other. More preferably, the end of the first loop pipe R1 is disposed deeply at one end of the buffering cap 60, and the end of the second loop pipe R2 is connected to the other end of the buffering cap 60, so that the high pressure refrigerant supplied into the buffering cap 60 through the first loop pipe R1 can be buffered in the buffering cap 60 and discharged along the second loop pipe R2.

The process of discharging the refrigerant in the structure of discharging the refrigerant for the linear compressor in accordance with the present invention will now be described.

When the piston 4 is linearly reciprocated in the cylinder 2, if the pressure inside the compression space P is below a set pressure, a thin suction valve 6 installed at one end of the piston 4 is opened so that the refrigerant can pass through an inflow hole 4*h* of the piston 4 and flow into the compression space P. The pressure inside the compression space P is raised, and the refrigerant is compressed in the states of the suction valve 6 and the discharge valve 58*a* closed. If the pressure inside the compression space P is over the set pressure, the discharge valve spring 58*c* is compressed so that one side of the discharge valve 58*a* can partially open one end of the cylinder 2.

When one side of the discharge valve 58*a* is opened, the high pressure refrigerant is discharged from the compression space P, and transferred to the discharge cap 59 through the communication holes H1, H2, H3 and H4 of the support cap 58*b*. As the volume of the high pressure refrigerant increases in the discharge cap 59, the pressure thereof can be partially reduced.

Since the piston 4 is continuously linearly reciprocated inside the cylinder 2, the high pressure refrigerant is discharged from the compression space P to the discharge cap 59, generating the pulsation. However, when the refrigerant flows from the first, second and third sub-discharge spaces 59*a*, 59*b* and 59*c* of the discharge cap 59 with the relatively small volume to the fourth sub-discharge space 59*d* of the discharge cap 59 with the relatively large volume, the pulsation of the refrigerant is partially reduced.

The pulsation of the refrigerant discharged from the compression space P is reduced in the discharge cap 59. The refrigerant is discharged from the discharge cap 59, and supplied to the buffering cap 60 through the first loop pipe R1.

The end of the first loop pipe R1 is disposed deeply in the buffering cap 60, and the end of the second loop pipe R2 is disposed in the opposite direction to the end of the first loop pipe R1 in the buffering cap 60. When the refrigerant is transferred from the first loop pipe R1 to the buffering cap 60 with the relatively large volume, the pulsation of the refrigerant is buffered. Thereafter, the refrigerant flows into the second loop pipe R2.

When the refrigerant flows through the second loop pipe R2 which is the relatively thin and long pipe, the pressure, vibration and noise of the refrigerant are reduced at the same time. The buffering member installed on the second loop pipe R2 improves the effect of reducing the vibration and noise of the refrigerant.

Since the piston 4 is repeatedly linearly reciprocated inside the cylinder 2, the high pressure refrigerant is continuously discharged through the discharge cap 59, the first loop pipe R1, the buffering cap 60 and the second loop pipe R2.

Although the preferred embodiments of the present invention have been described, it is understood that the present invention should not be limited to these preferred embodiments but various changes and modifications can be made by one skilled in the art within the spirit and scope of the present invention as hereinafter claimed.

The invention claimed is:

1. A structure for discharging a refrigerant for a linear compressor, comprising:

a cylinder in which the refrigerant flows in the axial direction;

a piston reciprocated inside the cylinder, for compressing the refrigerant;

a discharge valve assembly installed at a first end of the cylinder and opened and closed for discharging the refrigerant, wherein the discharge valve assembly includes a discharge valve for opening and closing the first end of the cylinder, a support cap fixed to the first end of the cylinder so as to cover the discharge valve and including a plurality of communication holes for discharging the refrigerant from inside the support cap, and a discharge valve spring for elastically supporting the discharge valve on the support cap; and a discharge cap for covering the discharge valve assembly, the refrigerant being discharged through the communication holes to a discharge space formed between the support cap and the discharge cap, the discharge space being partitioned into a plurality of sub-discharge spaces having different sizes, wherein the plurality of sub-discharge spaces include a plurality of small volume sub-discharge spaces and a large volume sub-discharge space, wherein the small volume sub-discharge spaces communicate with each other and the small volume sub-discharge spaces communicate with the large volume sub-discharge space, the discharge cap reducing a pulsation of the refrigerant by making the refrigerant flow from the small volume sub-discharge space to the large volume sub-discharge space.

2. The structure for discharging the refrigerant of claim 1, further comprising a first loop pipe having a first end connected to the large volume sub-discharge space in the discharge cap, and guiding external discharge of the refrigerant.

3. The structure for discharging the refrigerant of claim 1, further comprising:

a first loop pipe having a first loop pipe first end connected to the discharge cap, and guiding external discharge of the refrigerant; and a buffering cap connected to a first loop pipe second end of the first loop pipe, for reducing the pulsation.

4. The structure for discharging the refrigerant of claim 3, further comprising a frame on which the cylinder is installed, wherein the buffering cap is installed on the frame.

5. The structure for discharging the refrigerant of claim 3, wherein the buffering cap has a smaller volume than the discharge cap.

6. The structure for discharging the refrigerant of claim 3, wherein the discharge cap further comprises a supplementary sub-discharge space which is smaller than the large volume sub-discharge space and larger than at least one of the plurality of small volume sub-discharge spaces, wherein the supplementary sub-discharge space is disposed between the large volume sub-discharge space and the at least one small volume sub-discharge space.

7. The structure for discharging the refrigerant of claim 3, further comprising a second loop pipe having a second loop pipe first end connected to the buffering cap, the second loop pipe guiding the refrigerant to be externally discharged from the buffering cap.

8. The structure for discharging the refrigerant of claim 7, wherein the first loop pipe second end and the second loop pipe first end are isolated from each other inside the buffering cap.

9. The structure for discharging the refrigerant of claim 7, wherein any one of the first loop pipe second end and the second loop pipe first end is positioned more deeply in the buffering cap.

10. The structure for discharging the refrigerant of claim 1, wherein the plurality of sub-discharge spaces are arranged along a circumference of a discharge valve assembly.

* * * * *